US005183960A

United States Patent [19]

Shires

[11] Patent Number: 5,183,960

[45] Date of Patent: Feb. 2, 1993

[54] ROCKET GLIDER STABILIZATION SYSTEM

[76] Inventor: James D. Shires, 28 W. Governor Dr., Newport News, Va. 23602

[21] Appl. No.: 722,528

[22] Filed: Jun. 27, 1991

[51] Int. Cl.[5] ..... F42B 4/08; A63H 27/00

[52] U.S. Cl. ..... 102/348; 102/347; 102/351; 446/68

[58] Field of Search ..... 102/347, 348, 351; 446/56, 63, 64, 68

[56] References Cited

U.S. PATENT DOCUMENTS

| | | | |
|---|---|---|---|
| 3,136,088 | 6/1964 | Crandall | 46/76 |
| 3,157,960 | 11/1964 | Schutz | 46/81 |
| 3,837,278 | 9/1974 | Gustafsson | 102/34.4 |
| 3,888,178 | 6/1975 | Senoski | 244/13 |
| 3,942,441 | 3/1976 | Senoski | 102/34.1 |
| 3,977,120 | 8/1976 | Held | 46/74 R |

*Primary Examiner*—Peter A. Nelson

*Attorney, Agent, or Firm*—Wallace J. Nelson

[57] ABSTRACT

A rocket glider stabilization system wherein a releasable, granular, counterweight, or ballast material is provided in the forward end of a model rocket aircraft to offset the weight of a tail mounted rocket motor assembly. The counterweight ballast material is releasably maintained in a counterweight bay formed at the opposite end of the model glider fuselage from the rocket motor. A rocket body tube connects the rocket motor with the counterweight bay and, when the ejection charge of the rocket motor is ignited, the ejection charge pressure ruptures or opens a retaining structure to release the ballast and maintain the desired center of gravity for glide flight of the rocket back to the ground. At least one adjustable or fixed trim tab is employed on at least one of the flight surfaces to induce the desired glide path return for the model aircraft.

15 Claims, 6 Drawing Sheets 10
14
12
16
18
20
22
II
II 10
12
14
18
22
24
25
26
27
28
30
31
32
34
35
36
38
40
42
CG-2

ROCKET GLIDER STABILIZATION SYSTEM

FIELD OF THE INVENTION

This invention relates to model airplanes in general, and relates specifically to model rocket gliders having center of gravity control mechanism for the rocket during powered and glide flight.

BACKGROUND OF THE INVENTION

Model rocket gliders are model aircraft that are launched into the air by a model rocket engine and are returned for a soft landing on the ground by a glide descent flight path. Model rockets are conventionally powered by solid rocket propellant charges and, after approaching maximum altitude or a height of several hundred feet, are designed to return to a soft landing by parachute or by a glide flight path.

One of the most prominent problems associated with previously designed rocket gliders has been the requirement of trim changes for proper flight during the powered and unpowered or glide stage. Some previous attempts to solve this problem include providing movable control surfaces on the flight vehicle, rocket engines that can move forward or aft, folding wings, jettisonable engine pods, and the like. When using jettisoned parts they are normally complex in design and operation which makes them susceptible to failure and, they also are aesthetically unattractive and not always easily recoverable.

Ejectable rocket nose cones that are replaced by a light weight nose cone, while simultaneously deploying wing elevators, have also been employed previously to adjust the center of gravity of model rockets during flight. These systems are complicated in operation and relatively expensive to produce. Also, the ejected rocket nose cones are not always easily recovered.

Parachute recovery of rocket launched model aircraft deprives the hobbyist of the excitement involved in a glide return flight.

Thus, a definite need resides in the art for a simple, inexpensive rocket glider stabilization system for use in the powered and unpowered glide return flight.

It is therefore an object of the present invention to provide a reliable, inexpensive rocket glider stabilizing system that employs a minimum number of parts and does not employ releasable parts that need to be recovered.

A further object of the present invention is to provide an inexpensive, counterweight, ejection device for rocket glider stabilization.

Another object of the present invention is to provide an improved counterweight ejection device for rocket glider stabilization.

An additional object of the present invention is to provide a releasable and expendable counterweight for a rocket glider that is ejected from the rocket when the rocket engine is expended.

Still another object of the present invention is an adjustable weight counterweight system for rocket gliders.

SUMMARY OF THE INVENTION

The foregoing and additional objects are attained according to the present invention by providing a rocket glider having at least one elongated rocket tube disposed therein with the aft end of the rocket tube housing a propellant rocket engine and the forward end of the rocket tube terminating adjacent a counter weight ejection bay formed in the fuselage of the rocket glider. A granular counterweight material is disposed in the counterweight ejection bay and retained therein by a tape or other suitable removable closure element. The granular counterweight material may be disposed directly in the fuselage counterweight ejection bay or may be pre-packaged in a suitable housing that snugly fits within the counterweight ejection bay, or is attached to the rocket tube and constitutes the counterweight ejection bay itself. A wadding is disposed within the forward end of the rocket tube adjacent a counterweight bay pressurization port to prevent any of the granular counterweight material from entering the rocket tube.

The granular counterweight material serves to offset the weight of the propellant charge during the powered flight of the rocket glider. When the propellant charge in the rocket engine is expended, the rocket glider has normally reached an altitude of several hundred feet and continues in an upward coasting mode until the weight of the granular counterweight material causes the rocket glider to pitch downward. During this coasting portion of the flight, a delay charge ignited by the propellant charge, ignites an ejection charge at the forward end of the rocket engine. The gases from the ejection charge expand and are pressurized in the rocket tube until they reach the pressurization port and pass therethrough to engage the wadding disposed adjacent the counterweight ejection bay. The gaseous pressure against the wadding forces the granular counterweight material against the retention tape adequately to remove the tape (or to open retention doors provided in the separate counterweight housing) to release the granular counterweight material into the atmosphere.

Upon release of the granular counterweight material, the rocket glider is no longer nose heavy and the aerodynamic balance or center of gravity thereof shifts aft to the desired location for glide flight of the rocket glider. Suitable adjustable trim tab surfaces are provided on one or more of the model flight surfaces to control the glide flight path of the returning rocket glider model.

BRIEF DESCRIPTION OF THE DRAWINGS

A more complete appreciation of the invention and many of the attendant advantages thereof will be more readily apparent as the same becomes better understood by reference to the following detailed description when considered in connection with the accompanying drawings wherein.

DETAILED DESCRIPTION

Figure 1:
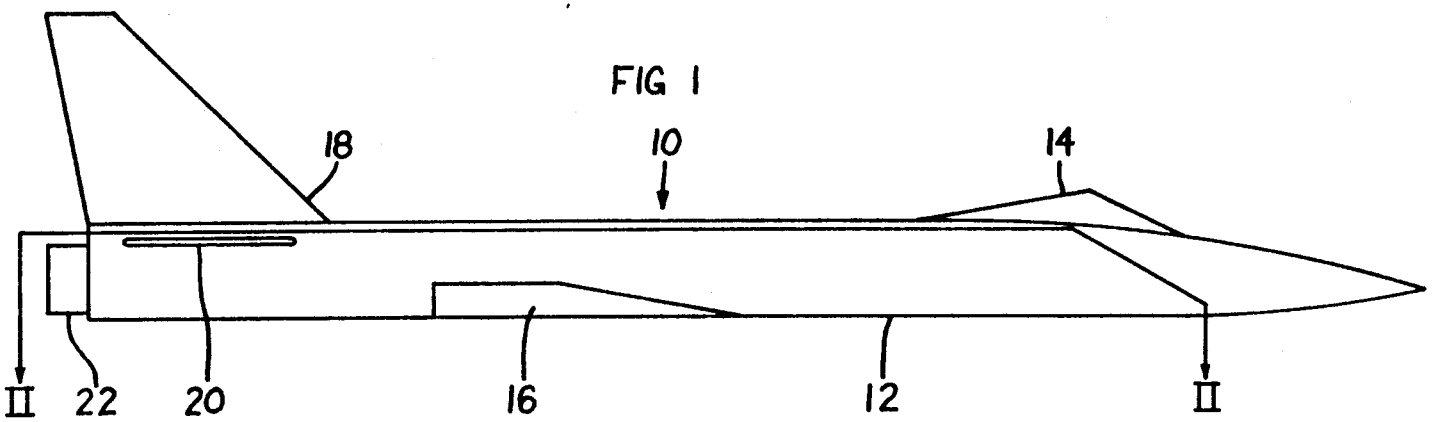
FIG. 1 is a side plan view of an exemplary rocket glider according to the present invention.

Referring now to the drawings and more particularly to FIG. 1, a side plan view of an exemplary rocket glider model aircraft according to the present invention is shown and designated generally by reference numeral 10. Model aircraft 10 includes an elongated hollow fuselage 12, a canopy 14, and a pair of wings, one of which is visible in this FIG. and designated by reference numeral 16. A rear empennage assembly is provided on model aircraft 10 and includes a vertical stabilizer 18 and a pair of horizontal stabilizers, one of which is visible in this FIG. and, designated by reference numeral 20. Model aircraft 10 is powered by a rocket engine 22, a portion of which is visible in this FIG. and, as will be further described hereinafter.

Figure 2:
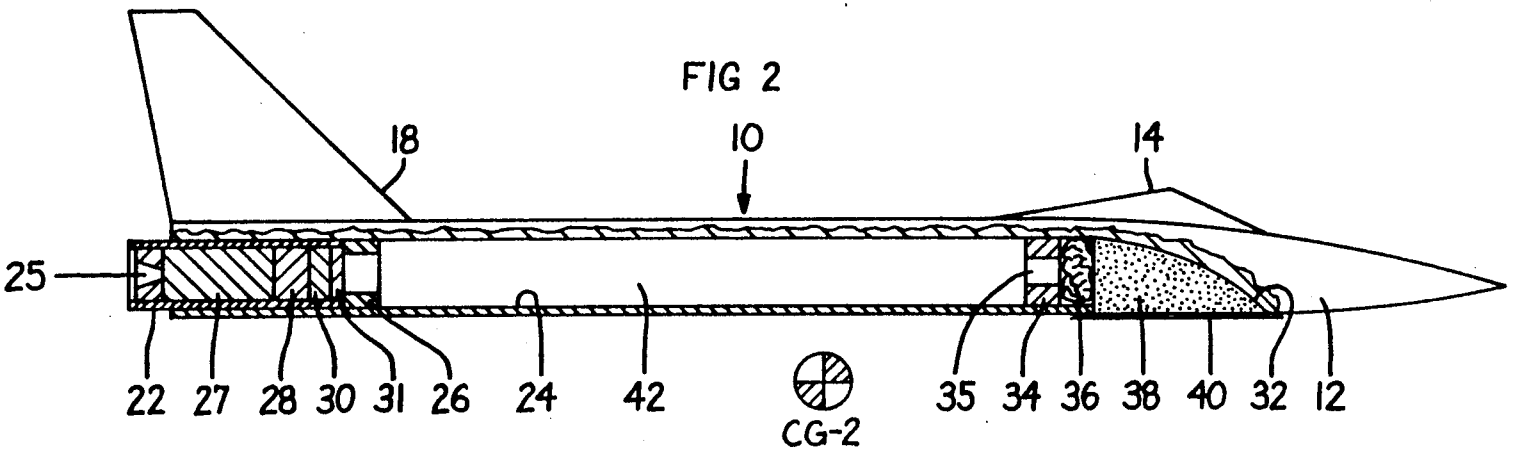
FIG. 2 is a part sectional view of the rocket glider shown in FIG. 1 and taken along line II—II thereof showing the interior of the rocket glider when prepared for launch.

Referring now more particularly to FIG. 2, this part sectional view of model aircraft 10 shows an elongated rocket tube 24 disposed within fuselage 12. The head end of rocket engine 22 is disposed within rocket tube 24 and abuts against engine stop ring 26. The aft end of rocket engine 22 extends from the aft end of rocket tube 24 and includes rocket nozzle 25. The major portion of rocket engine 22 is filled with a propellant charge 27.

One end of propellant charge 27 abuts rocket nozzle 25 and the other end abuts a delay charge 28. An ejection charge 30 is disposed between delay charge 28 and a clay plug 31. Clay plug 31 is positioned at the head end of rocket engine 22 adjacent engine stop ring 26.

The forward end of rocket tube 24 terminates adjacent a counterweight bay 32 formed in the bottom surface of fuselage 12. A tube wadding stop ring 34 is disposed within rocket tube 24 and spaced from the forward end thereof. A pressurization port 35 is provided within wadding stop ring 34. A wadding 36 closes the forward end of rocket tube 24 and is disposed against wadding stop ring 34.

Figure 6:
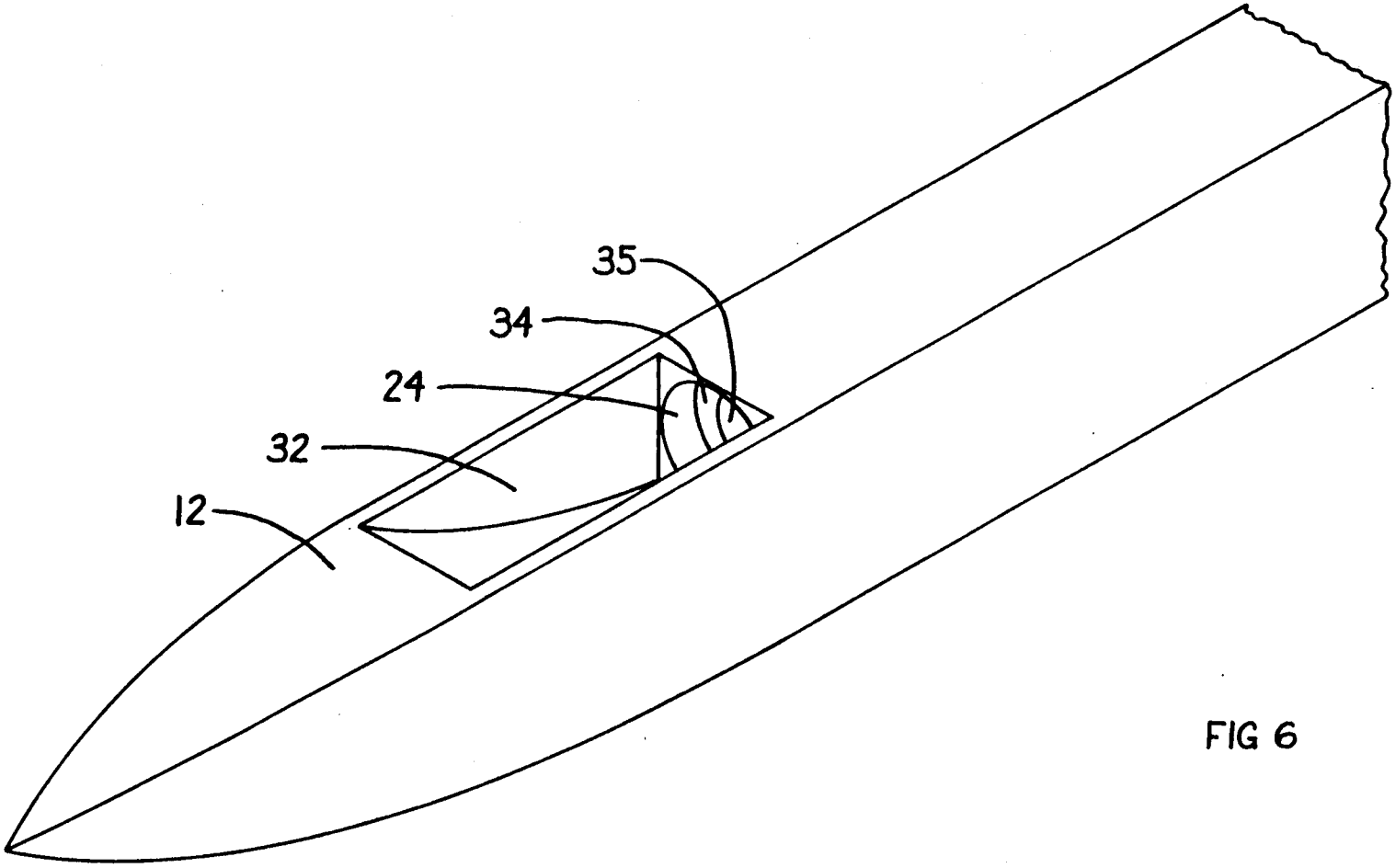
FIG. 6 is a part bottom perspective view of the rocket glider shown in FIGS. 1–5 and illustrating the counterweight ejection bay of the present invention.

In the illustrated embodiment counterweight bay 32 is provided with a curved or arcurate top surface area, parallel sides and an open bottom extending along the bottom fuselage 12 and is more clearly illustrated in FIG. 6. A quantity of granular material 38 is disposed within counterweight bay 32 and releasably retained therein by an adhesive backed tape strip 40 fastened to the bottom of fuselage 12 and covering counterweight bay 32. Granular material 38 may be formed of sand, plastic weighted beads, shot or other expendable material.

The area 42 of rocket tube 24 between engine stop ring 26 and tube wadding stop ring 34 serves to receive the expansion gases from ejection charge 30, as will be more thoroughly explained hereinafter.

When rocket engine 22 is initially positioned within rocket tube 24, the aerodynamic center or center of gravity of model aircraft 10 shifts toward the aft end of model aircraft 10. A specific quantity of sand, or other granular counterweight material 38 is then positioned within counterweight bay 32 to balance or counteract the weight of the rocket engine 22 and thereby locate the center of gravity of model aircraft 10 to the CG-2 position, a point that has been determined the desired location for the vehicle center gravity for optimum powered flight. The CG-2 location provides the model with a slight nose heavy condition which is necessary for a straight flight path during the thrust phase of the flight pattern.

Figure 3:
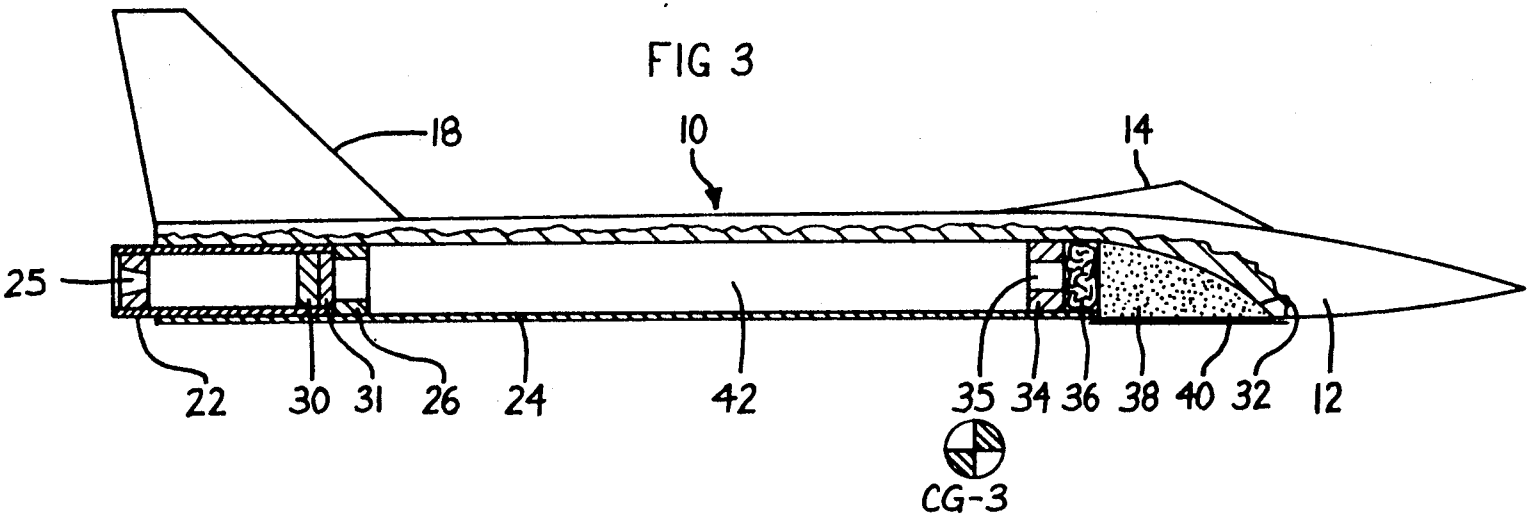
FIG. 3 is a view similar to FIG. 2 showing the interior of the rocket glider of the present invention during the coasting portion of a flight pattern.

Referring now more particularly to FIG. 3, model aircraft 10 is shown after propellant charge 27 has been expended but prior to ignition of ejection charge 30. At this stage of flight, model aircraft 10 is no longer being propelled and has entered into a coasting mode. The loss of the propellant charge 27 weight causes the aircraft center of gravity to shift forward from the optimum CG-2 to the CG-3 position shown due to the weight of the counterweight material 38 in counterweight bay 32. This nose heavy CG-3 condition lasts only until ejection charge 30 is ignited to effect ejection of counterweight material 38.

The expansion gases from ejection charge 30 proceed into area 42 of rocket tube 24 where they are compressed and pass through pressurization port 35 in tube wadding stop ring 34. These pressurized gases serve to force wadding 36 to exert sufficient pressure on counterweight material 38 to overcome the adhesive on tape strip 40 and thereby release counterweight material 38 into the atmosphere.

Figure 4:
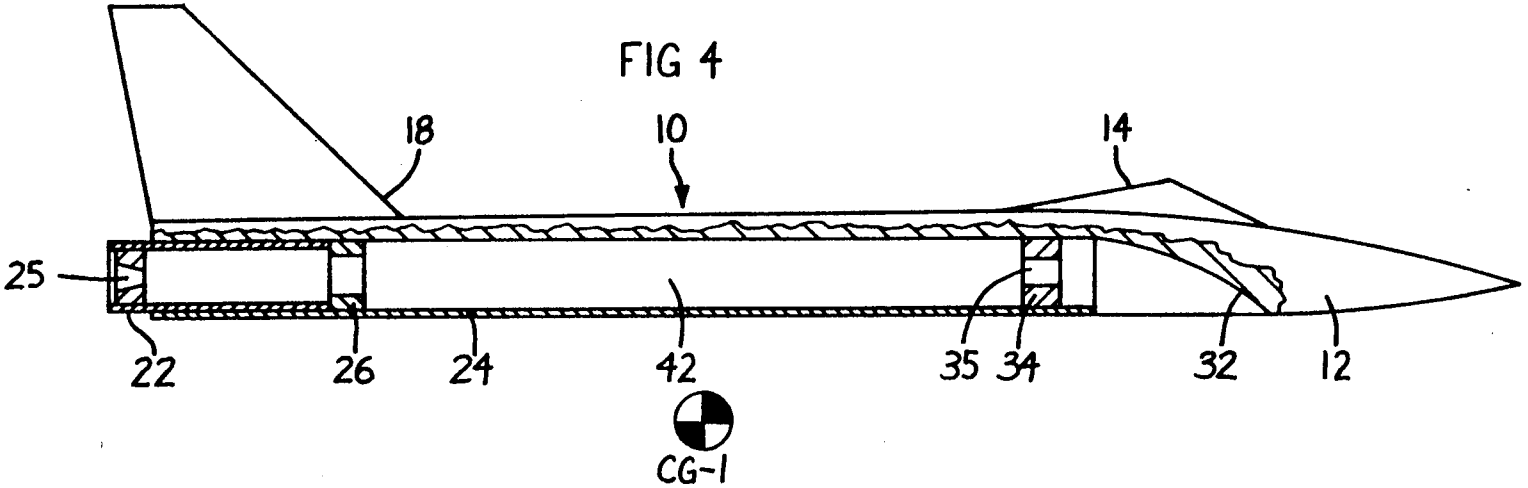
FIG. 4 is a view similar to FIGS. 2 and 3 and illustrating the rocket glider of the present invention during the glide stage of a flight pattern.

Upon release of counterweight material 38, model aircraft 10 is no longer nose heavy and, the center of gravity shifts from the CG-3 position shown in FIG. 3 to the CG-1 position illustrated in FIG. 4. As shown in FIG. 4, the counterweight bay 32 and rocket engine 22 are now empty and model rocket 10 is ready for its glide descent back to the ground. The CG-1, or longitudinal center of gravity, location for model aircraft 10 is slightly aft of the CG-2 launch location and ensures a smooth glide return to the ground.

Figure 5:
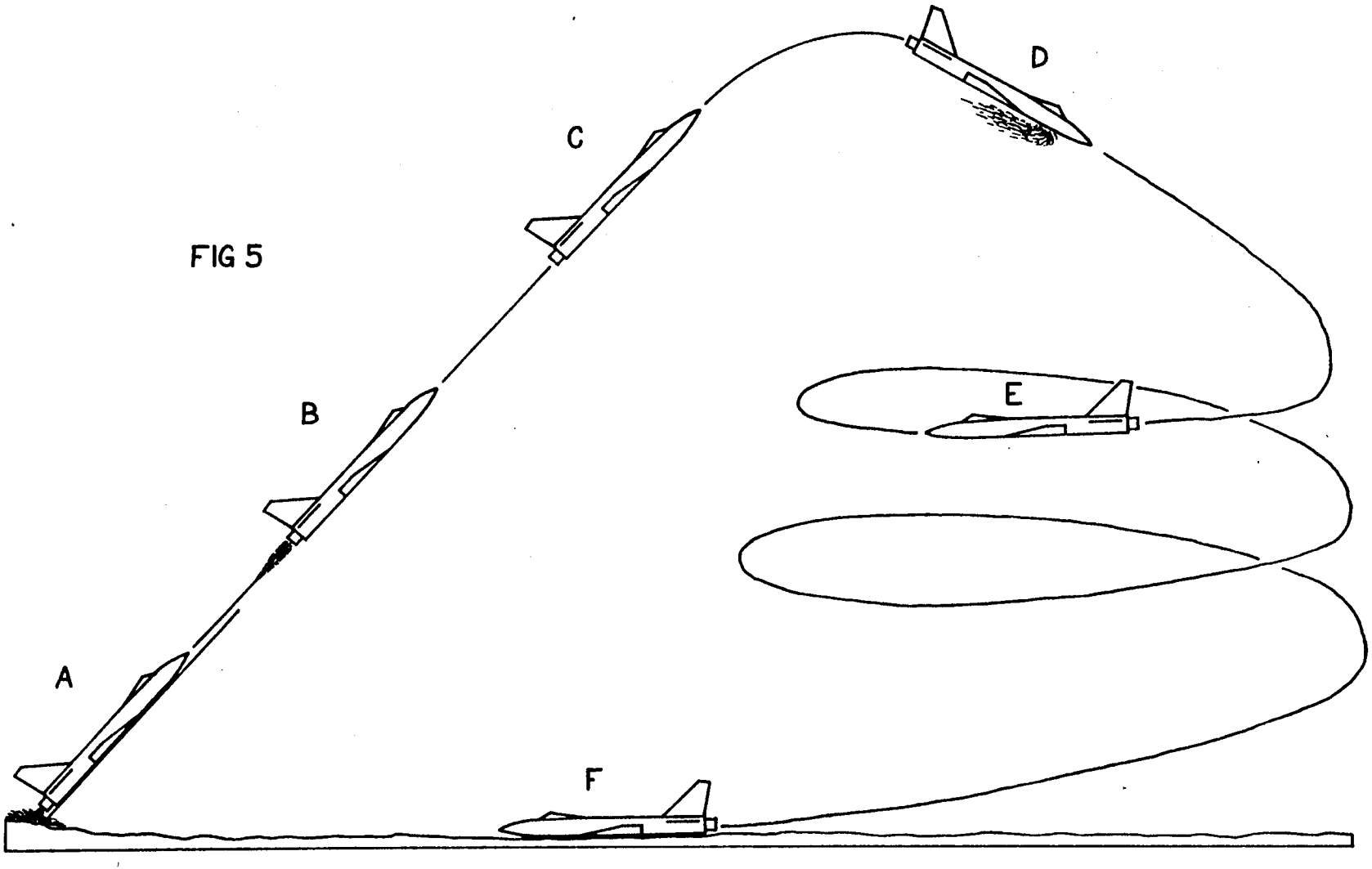
FIG. 5 is a view of an exemplary flight sequence of the rocket glider according to the present invention.

Referring now more particularly to FIG. 5, an exemplary flight sequence for the rocket glider illustrated in FIGS. 1–4 is shown. As illustrated therein, model aircraft 10 is launched at the appropriate angle for the flight path desired at point A. Model aircraft 10, at this point, is as illustrated in FIGS. 1 and 2 with rocket engine 22 installed therein by a conventional clip mechanism (not shown) and the necessary quantity of counterweight material 38 to balance or offset the weight of the loaded rocket engine 22 being retained in counterweight bay 32 by adhesive tape strip 40. The empty rocket engine casing remains with model aircraft 10 during its return glide flight. The center of gravity for model aircraft 10 at launch is as designated CG-2 in FIG. 2.

During the thrust stage of the flight, designated by position B, model aircraft 10 gains altitude and momentum while propellant charge 27 in rocket engine 22 is being expended. The center of gravity during this period is gradually shifting from the CG-2 position (FIG. 2) to the CG-3 position illustrated in FIG. 3. When propellant charge 27 is expended the model aircraft 10 has reached a height of several hundred feet and enters into the coast phase C of the flight sequence. While coasting, and with delay charge 28 burning, the nose heavy CG-2 aircraft flight sequence is as designated by reference C.

After a short while the nose heavy aircraft 10 starts to pitch downward (reference D). At essentially the same time, ejection charge 30 is ignited by delay charge 28 to expel or jettison the counterweight material 38 from counterweight bay 32 and shift the center of gravity of model aircraft 10 from the CG-3 position to the CG-1 position shown in FIG. 4 for optimum glide (reference E) flight back to a landing on the ground (reference F). The glide path for model aircraft is controlled by adding one or more suitable trim tabs to one or more flight or lift surfaces on model aircraft 10, as will be further explained hereinafter.

Figure 7:
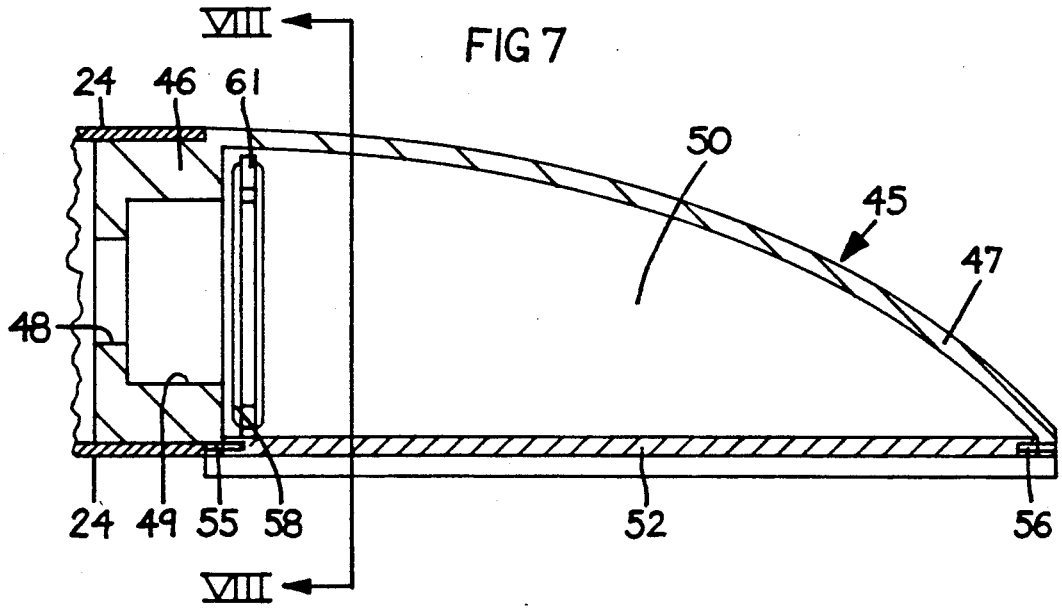
FIG. 7 is a view of a modified counterweight ejection system wherein a unitary housing is employed to releasably contain the counterweight material.
Figure 8:
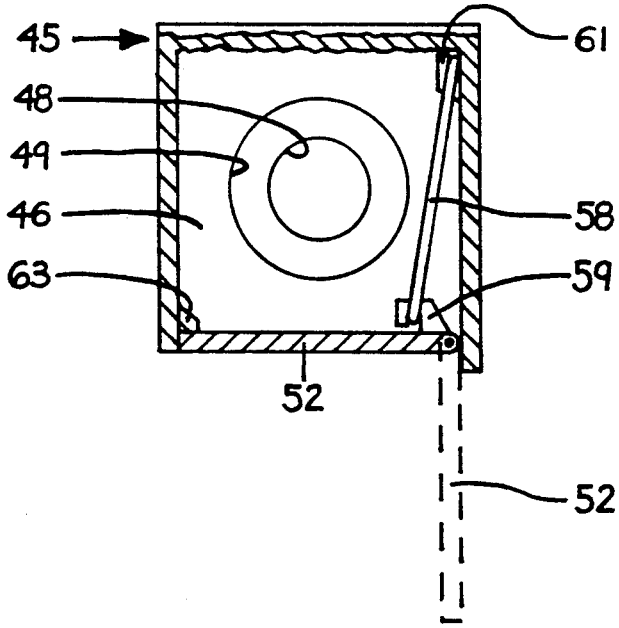
FIG. 8 is a view of the unitary counterweight assembly shown in FIG. 7 taken along line VIII—VIII thereof.

Referring now more particularly to FIGS. 7 and 8, a modified counterweight retention and release apparatus will now be described. As shown therein a separate housing, generally designated by reference numeral 45, is provided to fit within counterweight bay 32 (FIG. 6) formed in fuselage 12 or to serve as the counterweight bay itself. Housing 45 is provided with a necked-down circular end 46 that frictionally fits within the forward open end of rocket tube 24 and a second end 47 that merges with and closes the forward end of counterweight bay 32. Circular end 46 of housing 45 is provided with a reduced diameter center opening therein that serves as a pressurization port 48 for ejection charge gases emanating from ejection charge 30 as described hereinbefore in reference to the embodiment illustrated in FIGS. 1–4. An annular cavity 49 formed in end 46 receives a wadding (not illustrated in this FIG.) and serves as a wadding stop ring, performing the same function as tube wadding stop ring 34 in the embodiment of FIGS. 1–4.

Housing 45 is provided with a cavity 50 to contain the granular counterweight material, not illustrated in this FIG. Housing 45 is provided with a door closure 52 pivotally connected to ends 46 and 47 by respective pivot pins 55,56. Door 52 is maintained in the closed position illustrated in FIG. 7 by retention member 58 connected to a hook bracket 59 and to hook fixture 61. Hook bracket 59 is attached to door 52 while fixture 61 is spaced therefrom and attached to a wall of housing 45. In the illustrated embodiment, retention member 58 is an elastomeric band that encircles or is hooked to bracket 59 and hook fixture 61 to provide an elastic or spring force to maintain door 52 in the closed position. Any suitable elastic member, such as a coil spring, rubber band, or the like, may be employed for retention member 58. A door stop 63 is secured to the inside surface of one wall of housing 45 and serves to limit the pivotal movement of door 52, under the influence of retention member 58, to a position flush with the bottom planar surface of fuselage 12.

In operation, a suitable wadding is disposed within wadding retention cavity 49 and the desired quantity of a granular counterweight material poured into housing cavity 50. The elastomeric force of retention member 58 is adequate to support the weight of the counterweight material and maintains door 52 in the closed position. Housing 45 may then be inserted into counterweight bay 32 (FIG. 6). If desired, a suitable adhesive coating is provided on the exterior surfaces of housing 45 that contact the surfaces of rocket tube 24 and counterweight bay 32.

When the rocket ejection charge is ignited, pressurization port 48 in housing 45 serves to permit passage of the pressurized gases therefrom against the wadding disposed within wadding retention cavity 49. These pressurized explosive gases force the wadding against the granular counterweight material in housing cavity 50 to overcome the elastic force of retention member 58 and permit housing door 52 to pivot about pivot connections 55,56 and open to the position shown in dotted line in FIG. 8. When open, door 52 releases the granular counterweight material from housing 50 into the atmosphere. Once the counterweight material is released, the expanding gases from the ejection charge are also released. Retention member 58 then forces door 52 to close again against door stop 63 and permit model aircraft 10 to return to the ground in a controlled glide path.

Housing 45 may initially be attached to rocket tube 24 and installed in a model aircraft 10 prior to being loaded with the granular counterweight material. Also, after a flight, housing 45 may be reloaded with counterweight material for the next flight. All model aircraft need not be provided with separate counterweight bays since housing 45 itself may serve as the counterweight bay needed for containing the counterweight material.

Figure 9:
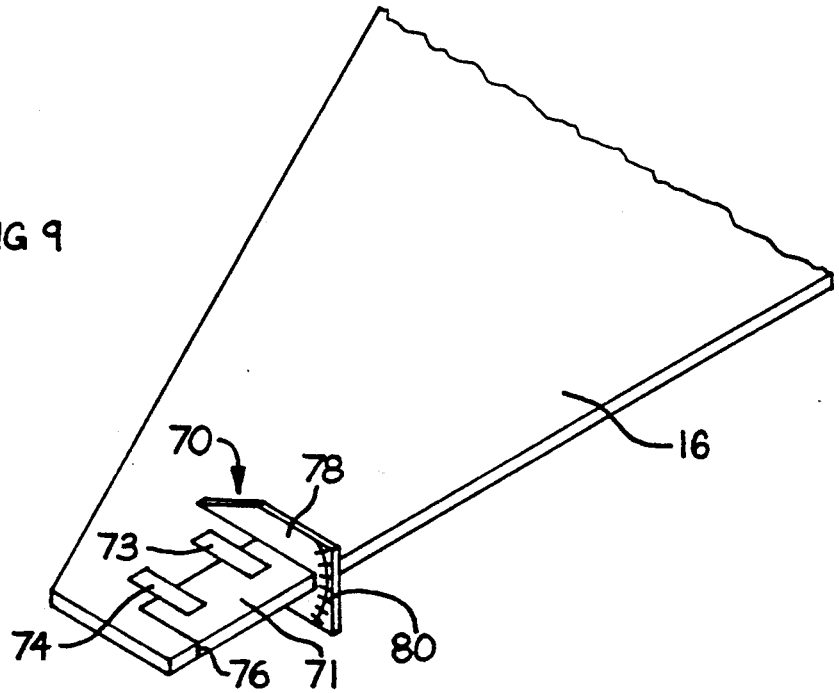
FIG. 9 is a perspective view of an angularly adjustable exemplary trim tab assembly employed on the rocket glider of the present invention.

Referring now to FIG. 9 trim structure for influencing the flight pattern for the model rocket aircraft is shown and designated generally by reference numeral 70. Trim structure 70 is employed to create extra lift or to spoil the lift of the flying (lift) surface on which it is mounted. In the illustrated embodiment trim structure 70 includes a trim tab 71 formed as part of the outboard trailing edge of one wing 16 of rocket model aircraft 10. Trim tab 71 is disposed within a cut-away opening 76, provided in the trailing edge of wing 16, and secured thereto by a pair of hinges 73,74. Trim tab 71 is of the same thickness as the cut-away opening 76 in wing 16 and has slightly smaller length and width dimensions to permit pivotal movement thereof within the cut-away area.

A vertically disposed adjustment mark plate 78 is secured to the aft end of wing 16 adjacent the trim tab cut-away opening 76 and extends slightly above and below the planar wing surface. Angular indicia marks 80 are provided on adjustment mark plate 78 in both the above and below wing portions thereof. Hinges 73,74 are formed of suitable bendable metal, such for example aluminum strips, to permit trim tab 71 to be adjusted to the desired position as measured by angular indicia marks 80 on adjustment mark plate 78. The metal strip hinges provide adequate rigidity to retain trim tab 71 in the selected and adjusted angular position during powered and glide flight of a model aircraft 10.

Thus, if trim tab 71 is adjusted to an up, or positive position, relative to wing 16, it will act as a spoiler to reduce lift and thereby cause an imbalance of lift between the aircraft wings to cause the model aircraft to bank and turn. If trim tab 71 is adjusted to the down, or negative position, relative to wing 16, it will act as a flap and increase the wing lift. This will also cause an imbalance of lift opposite to that created by the spoiler effect resulting in the model aircraft banking and turning in the opposite direction.

Adjustment mark plate 78 is employed to indicate the degree of tab deflection for a specific flight and thereby provide an easy reference when adjusting trim tab 71 for the desired flight pattern. Proper adjustment of trim tab 71 ensures a smooth glide return in a circular pattern to control the area in which model aircraft 10 returns to the ground.

The speed of a model aircraft also has an effect on the ability of the trim tab to turn or bank a model. During high speed thrust and coast stages of a model rocket glider flight, the trim tab may cause the model rocket to roll. As the speed of the model reduces, the trim tab will lose its effectiveness causing the model to stop rolling and go into a controlled turn. Also, the size and location influences the effectiveness of a trim tab. For example, a trim tab mounted on the outboard portion of a wing will have a greater effect on the flight path than a trim tab mounted on the inboard wing portion. Also, a larger surface area trim tab will have a greater effect than a small surface area tab.

Figure 10:
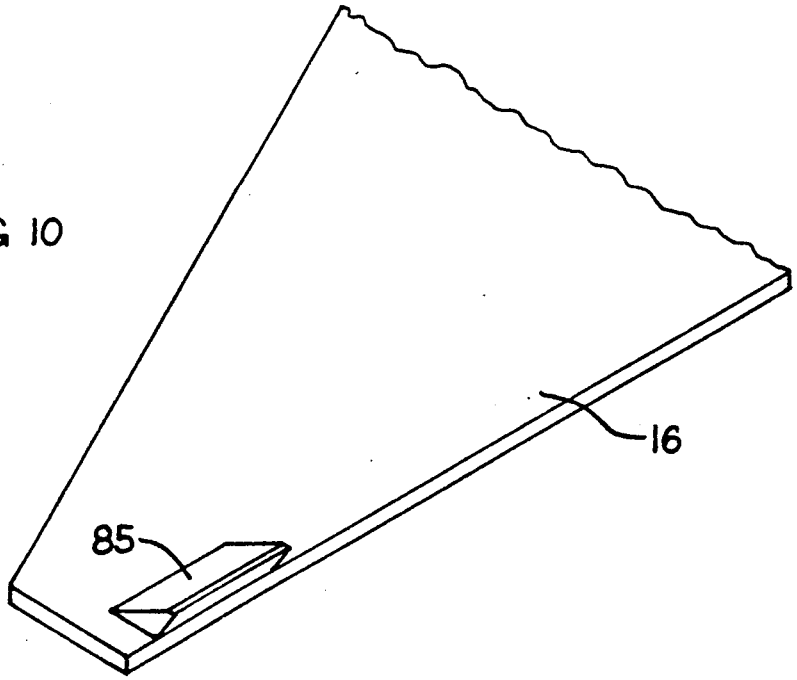
FIG. 10 is a view of an alternate trim tab fixed to one of the flight surfaces on the rocket glider of the present invention.

An alternate trim tab structure is illustrated in FIG. 10. As shown therein, a fixed, simple, one piece trim tab 85, provided with the desired angular surface is taped, glued, or otherwise secured on a model aircraft flight surface 16. The location and position of trim tab 85 is selected to produce the desired flight pattern characteristics.

Although the invention has been described relative to specific embodiments thereof, it is not so limited and there are numerous variations and modifications thereof that will be readily apparent to those skilled in the art in the light of the above teachings. For example, although the trim tabs described herein have been confined to the use of a single trim tab on a model, the invention is not so limited. Trim tabs may be employed on any one or all flight surfaces, or in any combination thereof on a model aircraft within the scope of the present invention. Obviously, the more trim tabs employed, the greater the flexibility the flyer has in choosing flight patterns for his model aircraft.

In addition to trim tabs used for roll control, trim tabs for pitch and yaw may also be employed. Yaw trim is accomplished by adding a trim tab to the vertical stabilizer while pitch trim is obtained by adding a trim tab to each horizontal stabilizer, canard, or a combination of these. It is also possible to obtain pitch trim by adding a trim tab to both wings of some models.

Also, although only expendable granular materials have been described in the preferred embodiments of the invention, the invention is not so limited. Granular materials are preferred due to the ease of handling and weight adjustments but a single solid object of the proper weight could be used for this purpose, as could a contained liquid, or other material or object(s).

Other modifications and variations of the specific embodiments of the invention described herein will appear obvious to those skilled in the art in the light of the above teachings. The specific examples described herein are therefore intended to be illustrative of the invention only and are not to be deemed as exhaustive.

It is therefore to be understood that, within the scope of the appended claims, the invention may be practiced other than as specifically described herein.

What is claimed as new and desired to be secured by Letters Patent of the United States is:

1. A rocket glider comprising:

a model rocket propelled aircraft having a center of gravity located at substantially the longitudinal center thereof;

a rocket engine having a solid rocket propellant disposed in the aft end of said aircraft for propelling said model aircraft;

a counterweight bay formed in the nose end of said model aircraft;

a counterweight material releasably provided in said counterweight bay to balance or offset the weight of said rocket engine and thereby maintain the center of gravity of said aircraft at substantially the longitudinal center thereof;

whereby when said model rocket aircraft is propelled on a flight by said rocket engine, as said solid propellant is expended from said rocket engine, the center of gravity of the aircraft will shift toward the aircraft nose end to effect a pitch down movement for said aircraft and including, means responsive to the depletion of said solid propellant for releasing said counterweight material into the atmosphere and thereby return the center of gravity of the aircraft to the substantially longitudinal center thereof to facilitate a controlled glide flight path back to the ground.

2. The rocket glider of claim 1 including said counterweight material being a granular material and an adhesive backed tape covering said counterweight bay to releasably retain said granular material therein and said means responsive to the depletion of said solid propellant for releasing said counterweight material into the atmosphere including gaseous pressure released from said rocket engine to disengage the adhesive backed tape from the counterweight bay.

3. The rocket glider of claim 2 including a separate housing disposed within said counterweight bay and containing said granular counterweight material therein.

4. The rocket glider of claim 3 including a door pivotally connected to said housing and elastomeric means normally retaining said door in closed position within said housing.

5. The rocket glider of claim 3 wherein said means responsive to the depletion of said solid propellant for releasing said counterweight material into the atmosphere includes a pressure producing ejection charge contained within said rocket engine, said pressure producing ejection charge being ignited when said solid propellant is depleted from said rocket engine.

6. The rocket glider of claim 1 including a rocket tube housing said rocket engine at an aft end thereof and in fluid communication with said counterweight bay at the forward end thereof, said means responsive to the depletion of said solid propellant for releasing said counterweight material into the atmosphere including a delay charge disposed within said rocket engine and ignited upon depletion of said propellant charge, an ejection charge ignited by said delay charge, said ejection charge producing a gaseous discharge into said rocket tube to said counterweight bay to effect pressure release of said counterweight material therefrom.

7. The rocket glider of claim 1 including at least one trim tab disposed on at least one flight surface of said model rocket propelled aircraft, said at least one trim tab serving to influence the flight pattern of said solid rocket propelled aircraft during the powered and glide portions of the flight pattern and wherein said at least one trim tab forms a part of the outboard trailing edge of one wing of said rocket propelled model aircraft, said at least one trim tab being angularly adjustable prior to launch of said aircraft in the up or down position relative to the planar surface of said wing to thereby selectively serve as a spoiler or a flap for the model aircraft.

8. The rocket glider of claim 7 wherein said trim tab comprises a plate of material having essentially the same thickness as the model aircraft wing and is connected to the model aircraft wing via a pair of hinges that permit movement of said trim tab relative to the planar surface of the model aircraft wing in the up or down direction at angles between ±90° and including an adjustment mark plate disposed on the trailing edge of the aircraft wing and adjacent said trim tab, said pair of hinges being a pair of aluminum strips that permit bending for adjustment of said trim tab and having sufficient rigidity to remain in the bent position to hold said trim tab in the adjusted position during a model aircraft flight pattern.

9. A rocket glider comprising, in combination:

a model rocket propelled aircraft;

at least one elongated model rocket tube having open forward and aft ends and disposed in said aircraft, an engine stop ring disposed within and spaced from said aft end of said at least one elongated model rocket tube;

an elongated solid propellant rocket engine having a head end disposed against said engine stop ring and a nozzle end extending from said aft end of said rocket tube;

said elongated solid propellant rocket engine having a rocket nozzle, a propellant charge adjacent said nozzle, a delay charge adjacent said propellant charge, an ejection charge disposed adjacent said delay charge and a clay plug closure at said head end;

a tube wadding stop ring disposed within said forward end of said at least one elongated model rocket tube;

said tube wadding stop ring having an axial pressurization port extending therethrough;

said tube wadding stop ring and said engine stop ring defining and forming the termini of an elongated pressure tube chamber within said rocket tube;

a tube wadding positioned adjacent said axial pressurization port of said tube wadding stop ring in said elongated model rocket tube;

a counterweight bay formed within said rocket glider adjacent said forward end of said elongated rocket tube;

a counterweight material disposed within said counterweight bay and serving as a counterweight to the propellant rocket engine to thereby maintain the center of gravity of said rocket glider at the desired location for optimum flight;

closure means for said counterweight bay for releasably securing said counterweight material within said counterweight bay; whereby when said propellant rocket engine is ignited the propellant charge therein will launch and propel said rocket glider to a height of several hundred feet, said propellant rocket engine changing in weight as the materials therein are expended causing a shift in the rocket glider center of gravity toward the nose thereof due to the weight of the counterweight material disposed within said counterweight bay, and when the propellant charge in said propellant rocket engine is expended, it ignites said delay charge that burns while the rocket coasts, with said delay charge igniting said ejection charge causing it to rupture said clay plug and expel the explosive gases therefrom into said elongated pressure tube chamber with said tube wadding stop ring axial pressurization port conveying said explosive gases to propel said tube wadding toward said counterweight bay and force said counterweight material to open said closure means and be released from said counterweight bay to thereby cause a shifting of the rocket glider center of gravity to the desired location for maximum glide flight of the rocket glider back to the ground.

10. The rocket glider of claim 9 wherein said counterweight material is a granular material.

11. The rocket glider of claim 10 wherein said closure means for said counterweight bay for releasably retaining said counterweight material within said counterweight bay comprises a strip of adhesive backed tape secured to said rocket glider and covering said counterweight bay formed within said rocket glider.

12. The rocket glider of claim 10 wherein said granular counterweight material is confined within a separate housing.

13. The rocket glider of claim 12 including said housing having a terminus disposed within and secured to said rocket tube, said terminus forming said tube wadding stop ring.

14. The rocket glider of claim 13 including a chamber in said housing terminus to receive said tube wadding and wherein said tube wadding serves to close said pressurization port in said tube wadding stop ring to prevent entry of said granular counterweight material into said rocket tubing.

15. The rocket glider of claim 14 wherein said closure means for said counterweight bay housing includes a pivotally connected door for said housing and elastomeric retention means contained within said housing for selectively maintaining said door closed and permitting pivotal opening thereof to release said granular counterweight material in response to pressure received within said housing from said rocket tube when said ejection charge is ignited.

* * * * *